United States Patent [19]

Harada

[11] 4,437,001

[45] Mar. 13, 1984

[54] CORONA GENERATING APPARATUS

[75] Inventor: Yoshiaki Harada, Hachioji, Japan

[73] Assignee: Konishiroku Photo Industry Co., Ltd., Tokyo, Japan

[21] Appl. No.: 265,376

[22] Filed: May 20, 1981

[30] Foreign Application Priority Data

May 31, 1980 [JP] Japan ..... 55-73869
Sep. 26, 1980 [JP] Japan ..... 55-134980

[51] Int. Cl.[3] ..... H01T 19/04
[52] U.S. Cl. ..... 250/324; 250/326
[58] Field of Search ..... 250/324, 325; 361/225, 361/230

[56] References Cited

U.S. PATENT DOCUMENTS

| | | | |
|---|---|---|---|
| 3,765,027 | 10/1973 | Bresnick | 250/324 |
| 4,041,312 | 8/1977 | Plumadore | 250/324 |
| 4,053,770 | 10/1977 | Tanaka et al. | 250/324 |
| 4,171,899 | 10/1979 | Yanagawa et al. | 250/325 |

*Primary Examiner*—Bruce C. Anderson
*Attorney, Agent, or Firm*—Jordan B. Bierman

[57] ABSTRACT

A corona generating apparatus having a charge regulating member disposed to face the area of a charge retaining member where no visual image is to be formed and disposed to make a contact with said charge retaining member. The charge regulating member is composed of an upper regulating member and a lower regulating member. The lower regulating member is a length slight greater than said upper regulating member. End of said charge regulating member is bent toward the surface of said charge retaining member.

4 Claims, 5 Drawing Figures

CORONA GENERATING APPARATUS

BACKGROUND OF THE INVENTION

1. Field of the Invention

The present invention relates to a corona generating apparatus and, more particularly, to a corona generating apparatus having a novel corona charge regulating member.

2. Description of the Prior Art

In general, the image forming process by an electrophotographic copying machine includes the steps of forming, on a charge retaining member having a photosensitive member consisting of an insulating photoconductive material, a latent image corresponding to the original image, by a corona discharge and an irradiation of light, and developing the latent image by a developer consisting mainly of thermoplastic colored fine particles to form a visible image.

In ordinary electrophotographic copying machine, suitable means are provided to regulate the width of charging of the photosensitive member to form peripheral area requiring no visualized image, i.e. non-image forming region, in order to save the toner and to prevent the contamination of peripheral portion of the recording paper by the toner.

The means for regulating the charging width on the photosensitive member, for instance, includes a regulating member made of an insulating material and disposed between the corona wire and the photosensitive member. By the presence of this regulating member, the generation of the corona discharge is avoided and the flow of the corona charge from the corona generating apparatus to the photosensitive member is physically prevented.

This regulating method, however, poses the following problem. For instance, when the discharge is made continuously due to a continuous copying operation, the insulating regulating member is electrostatically charged so that the corona ion falls onto the photosensitive member at positions away from the regulating member, by the force acting between the charge and the corona ion.

In other words, the actual charging width is smaller than the width of the corona generator regulated by the charging regulating member of the corona generating apparatus.

Another drawback is that the charging width tends to fluctuate depending on the state of charging of the insulating regulating member. It is also known that the fluctuation owes also to other factors such as the distance between the regulating member and the photosensitive member, material of the regulating member, continuity of the copying work and the charging voltage. Namely, the fluctuation is increased as the distance between the regulating member and the photosensitive member is increased, and as the insulating power of the regulating member is increased. Similarly, the fluctuation is increased as the charging voltage becomes lower and as the copying operation is continued.

On the other hand, the charging width fluctuates also by the change in the distribution of electric field between the corona wire and the photosensitive member near the end of the regulating member. It is, therefore, necessary to stabilize this electric field. If the regulating member is made of a conductive material, the potential of the regulating member is advantageously kept at 0 volt. In this case, however, the strength of the electric field between the wire and the regulating member is increased excessively so that the regulating member absorbs even the charges which are away from the ends of the regulating member. Consequently, a potential difference is created between the central portion and end portions of the photosensitive member. In some cases, a thundering is caused between the wire and the regulating member. The use of the conductive material as the material of the regulating member, therefore, poses defects in quality of the picture and the safety.

To avoid these defects, it has been proposed to use a semi-conductive material as the material of the regulating member or to apply a bias voltage of the same potential as the photosensitive member to the conductive regulating member. The use of the semi-conductive material, however, poses a difficulty in setting the path for stably flowing the electrostatic charges, as well as unstable factors concerning the control of the semi-conductivity of the material. On the other hand, the regulating method employing a bias voltage is also unsatisfactory because of an increase of the electric current into the biasing circuit resulting in a lowered charging efficiency and raised cost.

SUMMARY OF THE INVENTION

Accordingly, an object of the invention is to provide a corona generating apparatus in which the charging width is effectively regulated stably and at a low cost, thereby to overcome the above-described defects of the prior art.

To this end, according to the invention, there is provided a corona generating apparatus of the type having a charge regulating member facing the area of a charge retaining member where no visible image is to be formed. Preferably, the regulating member is composed of an upper regulating member and a lower regulating member having a length slightly greater than that of the upper regulating member, the lower regulating member being contactable at its end with the charge retaining member.

The above and other objects, as well as advantageous features of the invention will become clear from the following description of the preferred embodiments taken in conjunction with the accompanying drawings.

DESCRIPTION OF THE PREFERRED EMBODIMENTS

Figure 1:
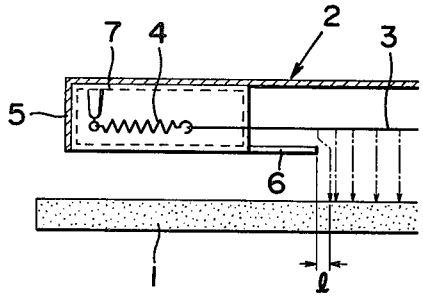
PRIOR ART FIG. 1
FIG. 1 is a side elevational view of a corona generating apparatus having a conventional charge regulating member.

Referring first to FIG. 1, a corona generating apparatus has a photosensitive member 1 which may be a drum type one, a corona generating apparatus 2, corona wire 3 and a spring 4 by which the corona wire 3 is stretched. A reference numeral 5 designates a back plate while a numeral 6 designates a charge regulating member which is, in this case, an insulating regulating plate. A reference numeral 7 denotes an attaching block for securing the spring 4 and the regulating member 6 to the back plate 5. In the corona generating apparatus, as stated before, the insulating regulating member 6 is undesirably charged during continuous discharge as in the case of continuous copying, so that the corona ion is made to fall upon the portions of the photosensitive member 1 away from the opened end of the regulating member 6, due to the force acting between the charge on the regulating member 6 and the corona ion. The distance between the opened end of the regulating member 6 and the position on which the corona ion falls is represented by l (see FIG. 1). In consequence, the actual charging width is smaller by l than the opening width of the charge regulating member 6. Ordinary, as the regulating members are disposed at both end of the photosensitive member, the actual charging width is smaller by 2 l than the opening width. In addition, a gradient of potential is formed at the charged end of the regulating member 6.

Figure 2:
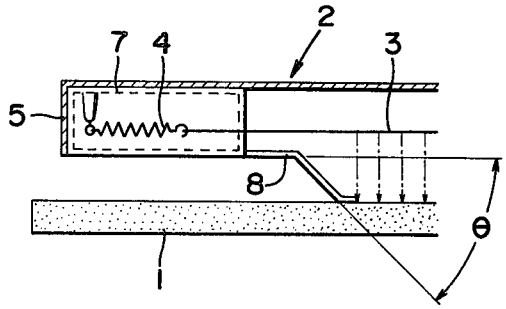
FIG. 2 is a side elevational view of a corona generating apparatus having a charge regulating member constructed in accordance with the present invention.

FIG. 2 shows a charge regulating member which is an improvement of the charge regulating member 6 shown in FIG. 1. The improved charge regulating member is designated at a reference numeral 8. This charge regulating member 8 is bent toward the surface of the photosensitive member 1 to make a slight contact at its bent end with the photosensitive member 1. The bending angle $\theta$ is preferably 45° or smaller. This charge regulating member 8 is preferably made of an insulating and flexible material, because it makes a contact with the photosensitive member 1. For instance, a polycarbonate resin, polyester resin or the like can be used as the regulating member 8.

Figure 3:
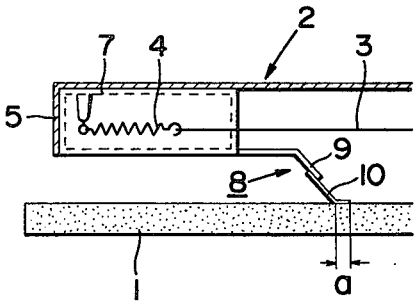
FIG. 3 is a side elevational view of a corona generating apparatus having a charge regulating member constructed in accordance with another embodiment of the invention.

FIG. 3 shows another preferred embodiment of the corona generating apparatus in accordance with the invention. In this corona generating apparatus 2, the regulating member 8 as used in the embodiment shown in FIG. 2 is composed of two different members. More specifically, referring to the drawings, a reference numeral 9 designates a regulating member of 1 mm thick. This regulating member 9 is made of a polycarbonate resin which is electrically insulating and rigid. This regulating member 9 is bent as illustrated and a flexible regulating member 10 is jointed to the bent end of the regulating member 9. The flexible regulating member 10 has a thickness of 50$\mu$ and is made of a polyester resin.

By using this composite construction, it is possible to construct the end portion of the charging member contactable with the photosensitive member 1 from a flexible material, while maintaining the flexible regulating member 10 at an inclination to the photosensitive member 1 at a predetermined angle by means of a rigid regulating member 9. It is, therefore, possible to maintain the most effective bent angle of the charge regulating member, while avoiding the damage in the photosensitive member 1 as a result of contact with the end of the regulating member.

In the drawing, a symbol a represents the length of the portion of the flexible charge regulating member 10 in contact with the photosensitive member 1. For instance, in the case where the photosensitive member is a drum type one, the shape of the end is so adjusted that the contact is made not only at the central portion of the regulating member 10 but also over the entire portion of the same.

Namely, in the event that the drum type photosensitive member 1 has a diameter of 230 mm, the value a mentioned above is 2 mm.

Figure 4:
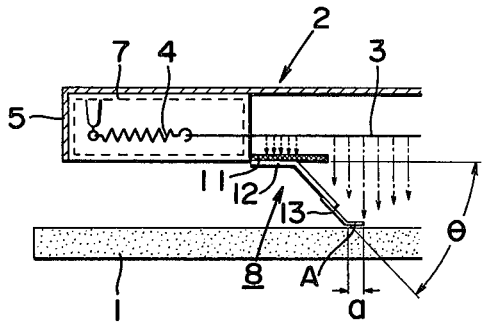
FIG. 4 is a side elevational view of a corona generating apparatus constructed in accordance with still another embodiment of the invention.

FIG. 4 shows a corona generating apparatus of another embodiment having a charge regulating apparatus which is an improvement of the charge regulating member 6 as shown in FIG. 1. In this embodiment, the charge regulating member 8 is composed of an upper regulating member 11 and lower regulating members 12, 13 jointed to each other and secured to the lower part of the upper regulating member 11. The lower regulating members 12, 13 may be constructed as one body.

The member 12 of the lower regulating members is bent toward the surface of the photosensitive member 1.

The lower member 13 makes a slight contact with the photosensitive member 1, at its lower end. In this case, the aforementioned bending angle is preferably 45° or smaller. The lower regulating member 13 is preferably made of an electrically insulating and flexible material because it makes a contact with the photosensitive member 1. Generally, a polycarbonate resin and polyester resins are used solely or in combination.

For instance, in order to stably maintain the bending angle $\theta$, the lower regulating member 12 are shaped from a polycarbonate resin of 1 mm thick having an electric insulating power and a sufficient rigidity. In addition, the end of the lower regulating member 13 is shaped from a flexible polyester resin of 50$\mu$ thick, in order to prevent the surface of the photosensitive member 1 contacted by the end of the lower regulating member 13. In case that the lower regulating members 12, 13 are formed in one body, they may be formed integrally from a polyester resin.

On the other hand, the upper regulating member 11 of the charge regulating member has a flat tabular form adhering to the upper one 12 of the lower regulating members and is extended slightly beyond the bending point of the lower regulating member 12. More specifically, the upper regulating member 11 has a length which is 0 to about 3 mm shorter than the lower regulating members 12, 13 as measured from the point A at which the leg of the lower regulating member 13 is bent to contact the surface of the photosensitive member 1. The upper regulating member 11 may be made of the same material as the lower regulating members 12, 13 to have an equal length to the latter. Therefore, if necessary, it is possible to form the upper regulating member 11 and the lower regulating members 12, 13 as a unit to form the regulating member.

As will be understood from the foregoing description, the corona generating apparatus of the present invention has an electrically insulating charge regulating member which has a reduced thickness and bent to provide a larger distance from the corona wire, so that the charging of the regulating member due to the discharge is reduced to prevent excessive outward divergence of the line of electric force. In consequence, the undesirable fall of the corona ion onto the portions of the photosensitive member away from the regulating member is avoided to stabilize the charging width even when the copying operation is made continuously.

According to the invention, the advantages stated above are derived from the bending of the charge regulating member. In this corona generating apparatus, however, the charging amount is locally increased at the end portion of the charge regulating member contacting the surface of the photosensitive member. From this point of view, a fogged or vague portion is formed in the copied material.

To avoid this, in the embodiment of the invention described before, the charge regulating member is constituted by an upper regulating member and lower regulating members to restrict the charging of the lower bent regulating member by the upper regulating member to eliminate or suppress the local increase of the electrostatic charge in the area near the end of the lower regulating member of the charge regulating member. In consequence, the fogging of the copy is prevented advantageously.

Figure 5:
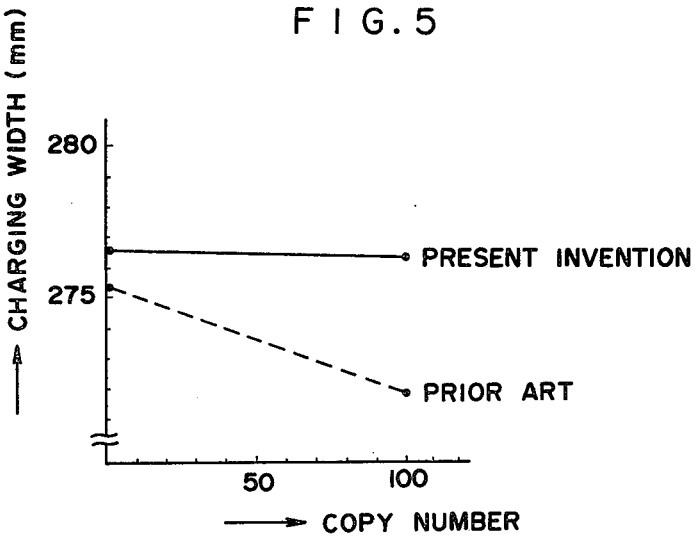
FIG. 5 is a graph showing the effect of regulating of charging width performed in the corona generating apparatus of the invention.

FIG. 5 is a graph showing the effect of the charge regulating member in the corona generating apparatus of the invention.

From this Figure, it will be seen that, in the copying machine having the corona generating apparatus of the invention, the charging width can be maintained constant irrespective of the number of copies, whereas, in the copying machine having a conventional corona generating apparatus, the fluctuation of the charging width appears when the number of copied sheets is increased in excess of, for example, 50.

In the present invention, a charging apparatus is illustrated as a corona generating apparatus, however, the corona generating apparatus can be applied same the corona charge transfer apparatus, corona charge eliminating apparatus and corona charge separating apparatus.

What is claimed is:

1. In a corona generating apparatus for charging a photosensitive surface, including a corona wire spaced from the photosensitive surface and from which charge is generated and a regulating member disposed between the wire and the photosensitive surface for preventing the accumulation of charge on the surface in a region at which no image is to be formed, the corona wire and the regulating member each being disposed substantially parallel to the photosensitive surface, the improvement comprising an improved regulating member to closely and accurately define the boundary of the non-image region on the surface, comprising:

an extension of said regulating member substantially longitudinally along the corona wire, said extension including a pair of bends delineating therebetween a ramp and a contact portion extending from the bend most remote from the regulating member, said contact portion being disposed substantially parallel to and in at least close proximity to the photosensitive surface to shield the surface of charge generated by the corona wire and, by reason of its close proximity to the surface, thereby closely define the boundary of said non-image region, at least said contact portion being formed of a flexible material so as to prevent damage to the photosensitive surface in the event that said portion contacts the surface, and each of said bends being less than 90 degrees.

2. In a corona generating apparatus in accordance with claim 1, wherein said extension, from a point on said ramp intermediate said bends through and including said contact portion, comprises a flexible member secured to and depending from said point intermediate the bends.

3. In a corona generating apparatus in accordance with claim 1, said extension further comprising:

an upper member having a first portion fixed to and extending on and along at least a portion of the regulating member, and extending through a first of said bends to a point along said ramp intermediate said bends; and a lower member of flexible material extending substantially from said point intermediate the bends to include the second of said bends and said contact portion, and being secured to and depending from said upper member at said point intermediate the bends.

4. In a corona generating apparatus in accordance with claim 1, each of said bends being no greater than 45 degrees.

* * * * *